US010532265B2

(12) United States Patent
Crawford et al.

(10) Patent No.: US 10,532,265 B2
(45) Date of Patent: Jan. 14, 2020

(54) SYSTEM FOR SENSOR-BASED OBJECTIVE DETERMINATION

(71) Applicant: Intel Corporation, Santa Clara, CA (US)

(72) Inventors: Richard Paul Crawford, Davis, CA (US); David I. Poisner, Carmichael, CA (US); Yuri I. Krimon, Folsom, CA (US)

(73) Assignee: Intel Corporation, Santa Clara, CA (US)

( * ) Notice: Subject to any disclaimer, the term of this patent is extended or adjusted under 35 U.S.C. 154(b) by 927 days.

(21) Appl. No.: 14/841,171

(22) Filed: Aug. 31, 2015

(65) Prior Publication Data

US 2017/0056748 A1 Mar. 2, 2017

(51) Int. Cl.

| | |
|---|---|
| ***A63F 9/24*** | (2006.01) |
| ***A63F 13/00*** | (2014.01) |
| ***G06F 17/00*** | (2019.01) |
| ***G06F 19/00*** | (2018.01) |
| ***A63B 71/06*** | (2006.01) |

(52) U.S. Cl.
CPC ..... *A63B 71/06* (2013.01)

(58) Field of Classification Search
USPC ..... 700/91; 463/1, 9, 20, 22, 25, 36
See application file for complete search history.

(56) References Cited

U.S. PATENT DOCUMENTS 7,707,528 B1 * 4/2010 White ..... G06F 17/5036 716/106
2009/0298588 A1 12/2009 Gopinath et al.
(Continued)

FOREIGN PATENT DOCUMENTS

| | | | |
|---|---|---|---|
| JP | 2015-141593 | A | 8/2015 |
| KR | 10-0455632 | B1 | 11/2004 |
| KR | 10-2014-0063105 | A | 5/2014 |

OTHER PUBLICATIONS

International Search Report and Written Opinion issued in PCT Application No. PCT/US2016/044381, dated Oct. 28, 2016.
(Continued)

*Primary Examiner* — Adetokunbo O Torimiro
(74) *Attorney, Agent, or Firm* — Grossman, Tucker, Perreault & Pfleger, PLLC

(57) ABSTRACT

The present disclosure is directed to a system for sensor-based objective determination. In general, sensor data may be used to render objective determinations that were not previously possible due to the unavoidable subjectivity of human-based officiating systems. For example, at least one device may be configured to make objective determinations during the course of a sporting event. Data collection circuitry may receive data from sensor devices coupled to players, equipment, playing surfaces, etc. Data analysis circuitry may categorize the data and input the data into a model to determine if an infraction occurred. For example, categorization may involve determining a type of infraction that may have occurred based on the sensor data. The model may then be selected based on the type of infraction, the model being developed utilizing prior sensor data, rules for the sporting event, etc. Output circuitry may generate a notification based on the infraction determination.

11 Claims, 5 Drawing Sheets

(56) References Cited

U.S. PATENT DOCUMENTS

| | | | | |
|---|---|---|---|---|
| 2013/0066448 | A1* | 3/2013 | Alonso | H04Q 9/00 700/91 |
| 2015/0088007 | A1* | 3/2015 | Bardy | A61B 5/0022 600/484 |

OTHER PUBLICATIONS

International Preliminary Report on Patentability and Written Opinion issued in PCT Application No. PCT/US2016/044381, dated Mar. 15, 2018, 9 pages.

* cited by examiner

SYSTEM FOR SENSOR-BASED OBJECTIVE DETERMINATION

TECHNICAL FIELD

The present disclosure relates to data processing systems, and more particularly, to a system for collecting sensor data, processing the data and generating objective determinations.

BACKGROUND

Some situations are predicated on a determination being rendered so that the situation is allowed to progress. If the determination is rendered by a human third party, the determination will unavoidably comprise some subjectivity. The subjective component may be based, at least in part, on perception that may be influenced by a variety of factors including the quality of data on which the determination is rendered, the environment, etc. In at least one practical example, sports officiating may be deemed to be most judicious when calls are made in a timely, accurate and fair manner. In an effort to reduce officiating errors caused by human perception and to improve accuracy and fairness, sports officiating has increasingly employed video replay. For example, a sporting event may be paused to allow officials to review video footage of a play. Video review may facilitate better post hoc judgments on calls that were made during the action of the game, and thus, for the correction of inadvertent officiating errors. Following the decision to allow a call to stand or to overturn the call based on the video review, game play may resume.

While the benefits of video replay are apparent, implementing video review is not a total solution, and may in some respects be problematic. Video replay occurs after the fact and is not capable of providing more clarity in real-time. Determinations made based on reviewing a video replay are unavoidably subjective based on the interpretation of the official and may be affected by various factors such as video quality, video capture angle, camera proximity, etc. As a result, video replay is an imperfect tool for clarifying what may have occurred in situations such as, for example, whether a player actually contacted another player, a game ball, game equipment, etc., and to what extent any contact may have affected game play. Implementing video replay may result in play being stopped repeatedly to allow for official review, which may annoy fans and cause scheduling issues due to sporting events running long. Additionally, there are a variety of training or game situations where the use of an official is desired but impractical or unaffordable.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

Figure 1:
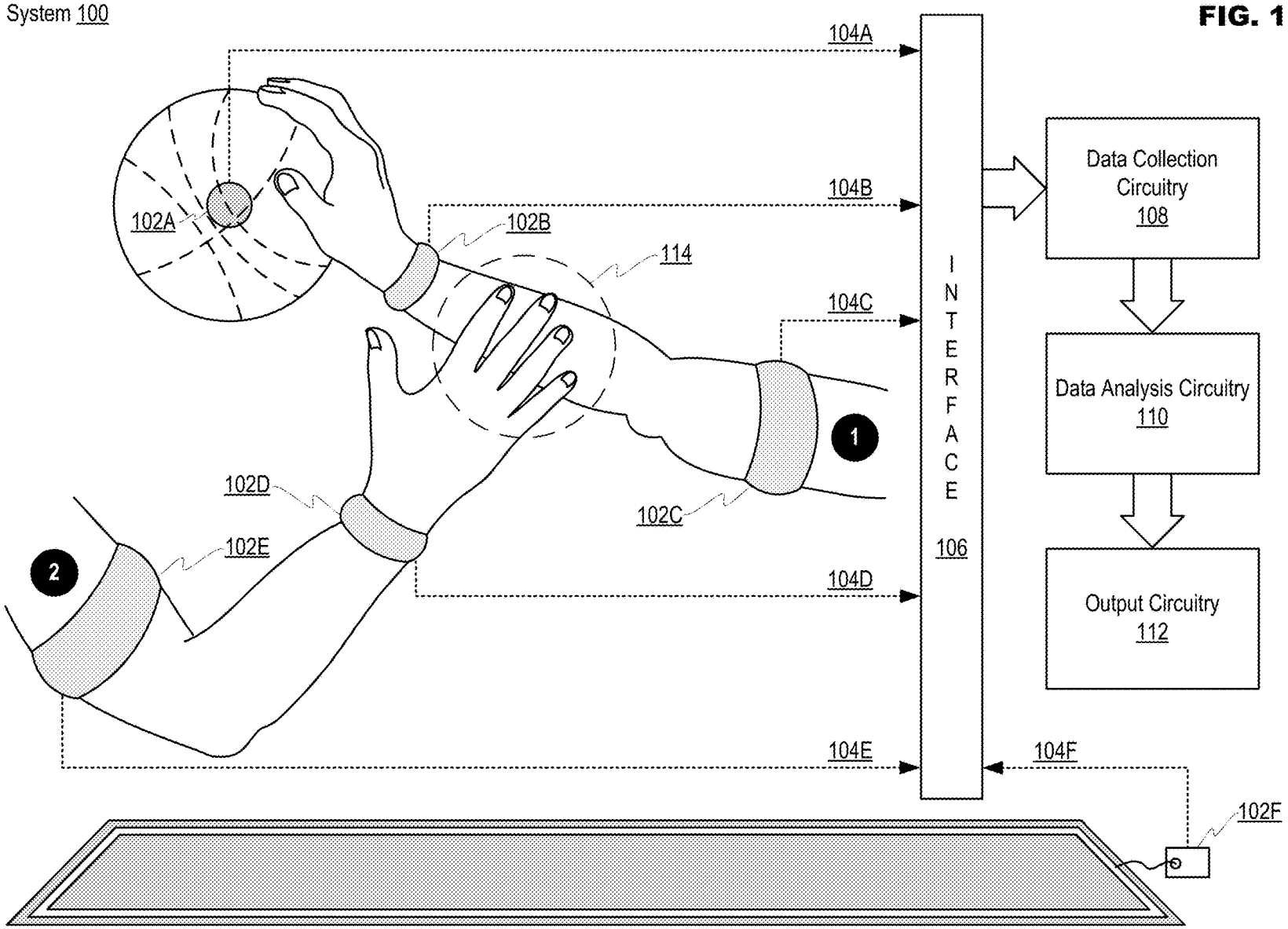
FIG. 1 illustrates an example system for sensor-based objective determination in accordance with at least one embodiment of the present disclosure.

Although the following Detailed Description will proceed with reference being made to illustrative embodiments, many alternatives, modifications and variations thereof will be apparent to those skilled in the art.

DETAILED DESCRIPTION

The present disclosure is directed to a system for sensor-based objective determination. In general, sensor data may be used to render objective determinations that were not previously possible due to the unavoidable subjectivity of human-based officiating systems. For example, at least one device including a variety of different circuitry may be configured to make objective determinations during the course of a sporting event. Data collection circuitry may receive data from various sensors coupled to players, equipment, playing surfaces, etc. Data analysis circuitry may categorize the data and input the data into a model to determine if an infraction occurred. In at least one embodiment, categorization may involve determining a type of infraction that may have occurred based on the sensor data. The model may then be selected based on the type of infraction, the model being developed utilizing prior sensor data, rules for the sporting event, etc. Output circuitry may generate a notification based on the infraction determination. In at least one embodiment, a determination that an infraction has occurred may also affect the game clock.

In at least one embodiment, at least one device for sensor-based objective determination may comprise at least communication circuitry, data collection circuitry, data analysis circuitry and output circuitry. The communication circuitry may be to transmit and receive data. The data collection circuitry may be to receive sensor data via the communication circuitry from at least one sensor device configured to monitor a sporting event. The data analysis circuitry may be to, for example, determine a category for the sensor data, input the sensor data into a model based on the category, determine whether an infraction occurred based on a model output and output circuitry to generate a notification based on the infraction determination.

In at least one embodiment, the data analysis circuitry may be to categorize sensor data received from at least one of a uniform sensor device, an equipment sensor device or a playing field sensor device as a potential individual infraction. The data analysis circuitry may comprise, for example, at least a learning engine to determine whether an infraction occurred based on the model. The model may be developed based at least on prior sensor data and rules governing the sporting event.

For example, the data analysis circuitry may be to categorize sensor data received from at least one player sensor device as a potential player-on-player infraction. The sensor data received from the at least one player sensor device may comprise at least contact data and acceleration data. The learning engine may be to determine characteristics for contact that occurred between players in the sporting event based on the contact data and whether the contact constitutes an infraction based at least on the acceleration data. The data analysis circuitry may be to cause a timing device for the sporting event to be affected based on the sensor data. At least one of the data collection circuitry or the data analysis circuitry may be to authenticate that the sensor data originated from the at least one sensor device. The sensor data may be authenticated based on source data incorporated within the sensor data by the at least one sensor device.

Consistent with the present disclosure, an example sensor device may comprise at least communication circuitry to transmit and receive data, sensor circuitry to generate sensor data regarding a sporting event and security circuitry to incorporate security data into the sensor data. The sensor circuitry may be configured to at least sense when a player wearing the sensor device contacts another player and acceleration of the player at least during a period of time when the sensed contact occurred. The security data may be based on biometric data from a player assigned to wear the sensor device and participating in the sporting event. Consistent with the present disclosure, an example method for sensor-based objective determination may comprise receiving sensor data from at least one sensor device configured to monitor a sporting event, categorizing the sensor data, inputting the sensor data into a model based on the category, determining whether an infraction occurred based on a model output and generating a notification based on the infraction determination.

FIG. 1 illustrates an example system for sensor-based objective determination in accordance with at least one embodiment of the present disclosure. While the present disclosure discusses implementations for making determinations regarding sporting events, these are merely readily comprehensible examples from which the various devices, systems, methodologies, etc. discussed herein may be understood. The variety of teachings presented herein may be equally as applicable to other types systems for facilitating the rendering of objective determinations.

System 100 may, in general, be configured to make objective determinations in sporting events based on sensor data. The determinations are objective because they are based solely on sensor data analyzed in terms of a model defined based on prior sensor data and game rules, and thus, are removed from the subjectivity that is inevitable in calls made by human officials. This subjectivity is inevitable because human officials make determinations based on their perception, which may be influenced by factors outside of a human official's control. Example factors may include distance of the official from the potential infraction, duration of the potential infraction, viewpoint of the official to the potential infraction, what else might was occurring at the time of the potential infraction, influences from participants (e.g., other officials, coaches, players, etc.).

Example system 100 may include at least one sensor device (e.g., sensor devices 102A, 102B, 102C, 102D, 102E and 102F, collectively "sensor devices 102A . . . F"), interface 106, data collection circuitry 108, data analysis circuitry 110 and output circuitry 112. Sensors devices 102A . . . F may generate sensor data related to the activities of players participating in a sporting event, uniforms and/or equipment worn by the players, game-essential equipment (e.g., balls, sticks, rackets, etc.), a play area (e.g., field, court, track, etc.) and/or other aspects of the sporting event that may be monitored. Sensor devices 102A . . . F may comprise sensors that determine, for example, contact and/or force (e.g., of a player with another player, a player with the equipment of another player, a player with game-essential equipment, etc.), velocity (e.g., of players, game-essential equipment, etc.), acceleration (e.g., of players, game-essential equipment, etc.), absolute and/or relative location (e.g., of players, game-essential equipment, etc.), temperature, proximity, number of attempts, etc. Example technologies for sensing data may include, but are not limited to, electromechanical or electronic (e.g., solid state) contact, motion, force, velocity, acceleration and/or temperature sensors, conductivity sensors, magnetic sensors (e.g., hall effect), light/dark sensors, audio and/or video sensors (e.g., microphones, still image cameras, video cameras, etc.), absolute location sensors (e.g., electronic compasses, global positioning system (GPS) sensors, etc.), relative location sensors (e.g., sensors for determining distance and/or direction to or from an electronic, audible or ultrasonic signal emitter), etc. Sensor devices 102A . . . F may comprise one sensor or combinations of sensors to sense data alone or collaboratively with another sensor (e.g., sensor data from contact and acceleration sensors may be used to determine impact force).

Consistent with the present disclosure, interface 106, data collection circuitry 108, data analysis circuitry 110 and output circuitry 112 may be implemented within a single device, in a combination of similarly-configured devices (e.g., a group of networked rack or edge servers) or in a combination of differently-configured devices (e.g., a wearable interface device and a data processing device). Examples of devices usable in possible implementations may include, but are not limited to, a mobile communication device such as a cellular handset or a smartphone based on the Android® OS from the Google Corporation, iOS® or Mac OS® from the Apple Corporation, Windows® OS from the Microsoft Corporation, Linux® OS, Tizen@ OS and/or other similar operating systems that may be deemed derivatives of Linux® OS from the Linux Foundation, Firefox® OS from the Mozilla Project, Blackberry® OS from the Blackberry Corporation, Palm® OS from the Hewlett-Packard Corporation, Symbian® OS from the Symbian Foundation, etc., a mobile computing device such as a tablet computer like an iPad® from the Apple Corporation, Surface® from the Microsoft Corporation, Galaxy Tab® from the Samsung Corporation, Kindle® from the Amazon Corporation, etc., an Ultrabook® including a low-power chipset from the Intel Corporation, a netbook, a notebook, a laptop, a palmtop, etc., a wearable device such as a wristwatch form factor computing device like the Galaxy Gear® from Samsung, an eyewear form factor computing device/user interface like Google Glass® from the Google Corporation, a virtual reality (VR) headset device like the Gear VR® from the Samsung Corporation, the Oculus Rift® from the Oculus VR Corporation, etc., a typically stationary computing device such as a desktop computer, a server, a group of computing devices organized in a high performance computing (HPC) architecture, a smart television or other type of "smart" device, small form factor computing solutions (e.g., for space-limited applications, TV set-top boxes, etc.) like the Next Unit of Computing (NUC) platform from the Intel Corporation, etc.

Interface 106 may be configured to receive signals including at least sensor data 104A, 104B, 104C, 104D, 104 and 104F (collectively, "sensor data 104A . . . F"). Sensor data 104A . . . F may be communicated via wired or wireless communication. Data collection circuitry 104 may at least collect the sensor data 104A . . . F and may provide it to data analysis circuitry 110 to be analyzed. In at least one embodiment, data collection circuitry 108 and/or data analysis circuitry 110 may classify sensor data 104A . . . F based on, for example, their source (e.g., sensor devices 102A . . . F that provided the data), the type of data provided, etc. Data analysis circuitry 110 may then make at least one objective determination based on sensor data 104A . . . F, For example, at least some of sensor data may be input into a model that may render the objective determination. In system 100, the objective determination may regard whether an infraction (e.g., foul, penalty, out-of-bounds, etc.) occurred. In another embodiment, the objective determination may clarify a positive game aspect (e.g., whether a baseball was hit foul or a home run, where a golf ball came down, whether a football went through the uprights, etc.). The objective determination may also affect other aspects of a game. Output circuitry 112 may be configured to generate a notification regarding the objective determination. A notification may be presented on at least one device (e.g., on a monitor in a computing device monitored by an official, on a device carried or worn by an official, etc.). Presentation may include generating a sound, displaying a visible indicator, providing a tactile output (e.g., vibration), etc. An objective determination that an infraction has occurred may also be followed by activity (e.g., a signal being transmitted) that causes a game clock to be affected. For example, the game clock may be stopped to allow the infraction to be handled (e.g., for a foul, penalty, etc.) to be assessed. In another example, time may be added to the game clock to rectify an officiating error, another game clock may be started (e.g., in soccer a clock may start counting to accumulate "wasted time" that may be added at the end of play, etc.). In another example of activity that may occur, the objective determination that an infraction has occurred may cause user interface operations such as the presentation of notification on personal or arena-wide user interfaces (e.g., monitors for officiating, large-scale monitors for patrons, etc.) that may identify the particular infraction, replay of video of the infraction, describe the penalty that will be invoked due to the infraction. For example, the notification and presentation may be designed to be a "triggering event" to an official (e.g., a sound in ear, haptic feedback, etc.) that may be considered as part of a larger set of factors that the official may consider in making their own call. System 100 may detect some criteria that may pertain to a certain call and then notify an official as to the existence of these criteria so that the official can ultimately make the call.

System 100 discloses an example of operation in regard to basketball. While basketball is used as an example to explain the disclosure, embodiments may be applicable to other games and other non-game systems. Sensor device 102A may be within, or at least affixed to, a piece of sports equipment such as a basketball. System 100 discloses at least two basketball players: player 1 (e.g., "❶") and player 2 (e.g., "❷"). Sensor devices 102B and 102C may be "worn" (e.g., affixed directly to a player's skin, incorporated within or affixed to an article of clothing or equipment worn by a player, etc.) by player 1, while sensor devices 102D and 102E are worn by player 2. Sensor device 102F may be affixed to a boundary line of a play area (e.g., basketball court"). During the course of play, sensor devices 102A . . . F may transmit signals comprising at least sensor data 104A . . . F to interface 106 for collection by data collection circuitry 108. Data analysis circuitry 110 may analyze at least some sensor data 104A . . . F, alone or in combination, to determine if an infraction has occurred. For example, sensor 102F may be able to detect when the basketball touches an out-of-bounds line based on contact sensed by sensor devices 102A and 102F or a player based on sensor devices 102B or 102D. The contact may be sensed by at least one of sensor devices 102A, 102B, 102D and/or 102F, and may be recorded in sensor data 104A, 104B, 104D and/or 104F (e.g., as data sensed based on radio frequency identification (RFID), as conduction data, as induction data, etc.). Moreover, a possible infraction where player 2 touches the arm of player 1 is shown at 114. Initially, sensor devices 102B and/or 102D may transmit signals including at least sensor data 102B and sensor data 102D, respectively, to data collection circuitry 108 via interface 106. Sensor devices 102B and/or 102D may sense the initial contact. In at least one embodiment, the use of multiple sensors, such as sensor devices 102B and 102D, on particular parts of a players body may indicate what part of a player's body made the contact (e.g., sensor data 104B and/or 104D may indicate that an upper extremity of player 1 touched an upper extremity of player 2). While a touch indicates the potential of an infraction, only certain contact is actually deemed a foul. Data analysis circuitry may use sensor data 104C and 104E, provided by sensor devices 102C and 102E, respectively, to determine whether an infraction has actually occurred. For example, sensor data 104C and 104E may comprise data such as, but not limited to, force data, velocity data, acceleration data, location data, etc. that may be employed along with the contact data to determine if an infraction occurred, what type of infraction, who caused the infraction, etc. After data analysis circuitry 110 make a determination as to whether an infraction occurred, output circuitry 112 may be configured to generate a notification as to one or more of whether an infraction occurred, the nature of the infraction, the player that is guilty of the infraction, the penalty, other infraction related statistics (e.g., personal fouls, team fouls, whether a team gets bonus free throws due excessive penalties), etc. In addition, output circuitry 112 may affect a game clock (e.g., stop, reset, increment, start another clock, etc.) when an infraction is determined to have occurred.

In the basketball example disclosed in FIG. 1, sensor devices 102A . . . F may be applied in ways not illustrated in system 100. FIG. 1 does not show in detail how sensor devices 102A . . . F in the players, equipment, court, etc. may interact with each other. Other sensor devices beyond those shown in association with sensor devices 102A . . . F (e.g., in shoes, in gloves, in equipment such as balls, rackets, etc.) may be used to sense players position within a playing area (e.g., was a player off sides, did a players foot/shoe go out of bounds, etc.), the last player to touch a ball before it goes out-of-bounds, the correlation of events occurring in the game to time (e.g., was a basket made or a goal scored before time ran out), etc. For example, sensor device 102A . . . F in shoes and the ball may be used to determine infractions such as when players "travel," when a shoe is inside the 3-second rule area for a certain period of time, when a shoe is over the line for free-throw, when a non-shooting player moved from the line too soon on free-throw, when a shoe is over the line for in-bounds pass and non-infraction activities such as whether the feet of a shooter were outside the 3-point line. Moreover, it is possible that an official (e.g., referee, umpire, judge, etc.) may make calls on their own volition, and system 100 may be employed to determine whether the call was correct, and if the call was deemed to be incorrect, whether the call may have inadvertently impacted the course of the game. In such an instance corrective action may be suggested by system 100 to correct the circumstances of the incorrect call (e.g., to the extent that correction is possible).

Modifications to the example illustrated in FIG. 1 are possible consistent with the present disclosure. For example, sensor devices 102B and 102C may be consolidated in a single device, and similarly sensor device 102D and 102E may likewise be consolidated in a single device. Moreover, while the disclosed example describes an example basketball application, a variety of other sports-related applications are possible. Other example applications include, but are not limited to, in golf: sensors in clubs may count actual number of swings to prevent players from purposely or inadvertently lowering their scores, in racket sports (e.g., tennis, racquetball, etc.): vibration sensors in racquets may help to determine if ball actually hit racquet, which may be an issue if the player if ball is going out of bounds and the player almost hits it and denies hitting it) and may also installed on the court (e.g., in the wall or net) to determine what the ball hits when flying, in boxing: vibration sensors in gloves may help to determine illegal hits (e.g., may make an objective determination as to whether actual contact occurred, in football: a sensor in the ball and precision location determination may help to determine if pass was forwards or backwards (e.g., a lateral), in soccer: sensors in shoes may determine if there is a "high kick" and/or ball sensors and precision location determination may help to determine "offsides" penalties, etc.

In at least one embodiment, security features may be incorporated to prevent system 100 from becoming compromised (e.g., to prevent the object determinations from being influenced by parties within or outside of system 100). The security features may allow data collection circuitry 108 and/or data analysis circuitry 110 to authenticate that sensor data 104A . . . F actually originated from sensor devices 102A . . . F being used in a sporting event, actually being worn by players participating in the sporting event, etc. For example, sensor devices 102A . . . F may be able to sense location-specific data, and may provide the location-specific data to circuitry 108 and/or 110 in a separate channel or as part of sensor data 104A . . . F. For example, worn sensor devices 102A . . . F may be able to determine biometric data such as, but not limited to, heartbeat, pulse, electrocardiogram (EKG), electroencephalogram (EEG) or Electromyography (EMG) signatures, gait patterns (e.g., weight shift, stride length, etc.), skin conductivity, etc. At least some of sensor devices 102A . . . F may be able to, for example, record security data such as listed above and use the security data to secure sensor data 104A . . . F. Securing sensor data 104A . . . F may comprise, for example, incorporating the security data into the signal used to transmit sensor data 104A . . . F, using the security data to encrypt sensor data 104A . . . F, etc.

Figure 2:
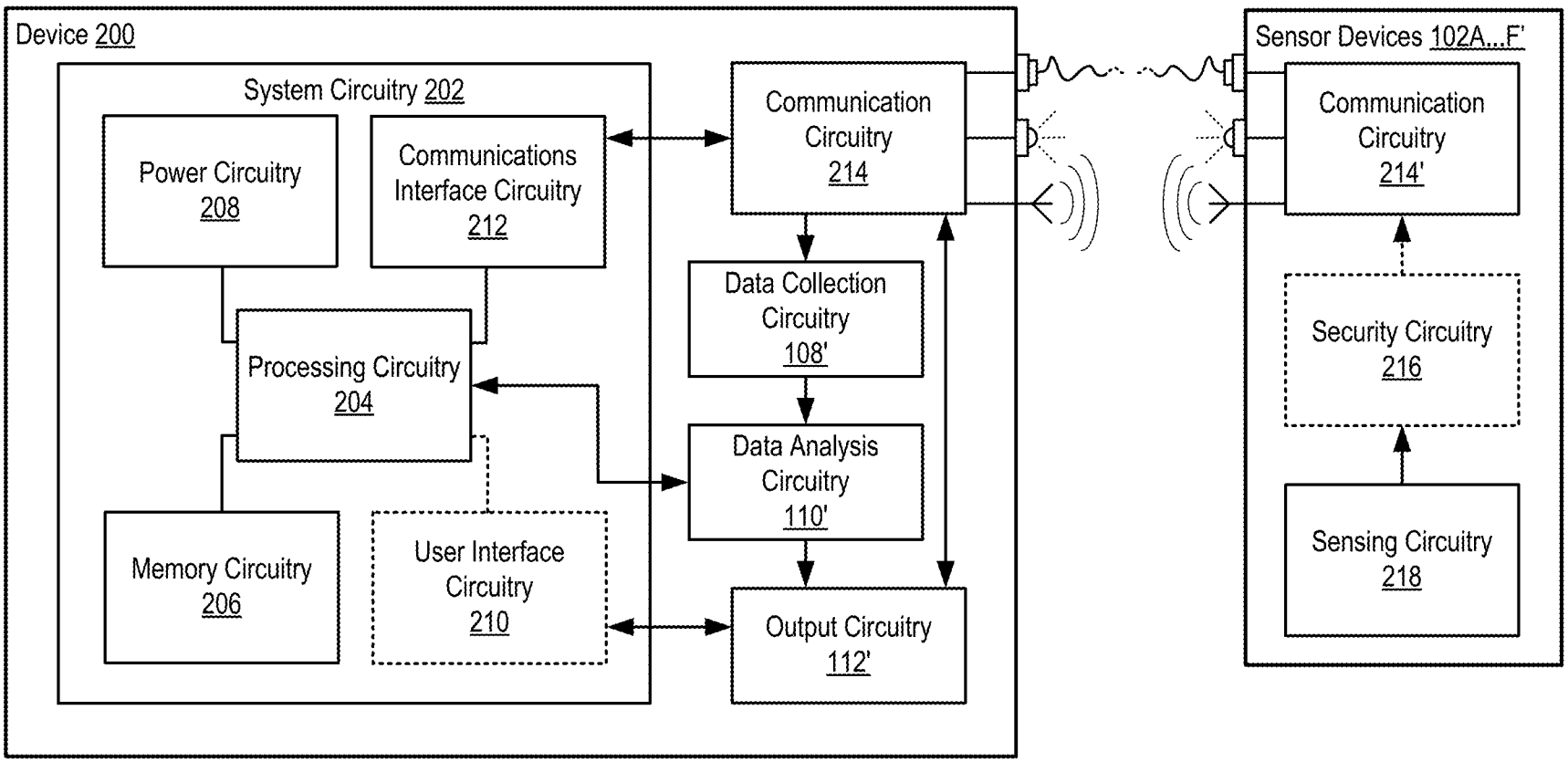
FIG. 2 illustrates an example configuration for devices usable in accordance with at least one embodiment of the present disclosure.

FIG. 2 illustrates an example configuration for devices usable in accordance with at least one embodiment of the present disclosure. The inclusion of an apostrophe after an item number (e.g., 100') in the present disclosure may indicate that an example embodiment of the particular item is being illustrated. Example devices 200 and 102A . . . F' may be capable of supporting any or all of the activities disclosed in FIG. 1. However, devices 200 and 102A . . . F' are presented only as an example of an apparatus usable in embodiments consistent with the present disclosure, and are not intended to limit any of the various disclosed embodiments to any particular manner of implementation. Moreover, while FIG. 2 illustrates only one device 200 including a variety of circuitry, this arrangement is merely an example. The functionality associated with the disclosed circuitry may also be allocated amongst a plurality of devices working alone or collaboratively.

Device 200 may comprise, for example, system circuitry 202 to manage device operation. System circuitry 202 may include, for example, processing circuitry 204, memory circuitry 206, power circuitry 208, user interface circuitry 210 and communications interface circuitry 212. Device 200 may further include communication circuitry 214, data collection circuitry 108', data analysis circuitry 110' and output circuitry 112'. While communication circuitry 214, data collection circuitry 108', data analysis circuitry 110' and output circuitry 112' are illustrated as separate from system circuitry 202, the example configuration of device 200 shown in FIG. 2 has been provided herein merely for the sake of explanation. Some or all of the functionality associated with communication circuitry 214, data collection circuitry 108', data analysis circuitry 110' and/or output circuitry 112' may also be incorporated into system circuitry 202.

In device 200, processing circuitry 204 may comprise one or more processors situated in separate components, or alternatively one or more processing cores situated in one component (e.g., in a system-on-chip (SoC) configuration), along with processor-related support circuitry (e.g., bridging interfaces, etc.). Example processors may include, but are not limited to, various x86-based microprocessors available from the Intel Corporation including those in the Pentium, Xeon, Itanium, Celeron, Atom, Quark, Core i-series, Core M-series product families, Advanced RISC (e.g., Reduced Instruction Set Computing) Machine or "ARM" processors or any other evolution of computing paradigm or physical implementation of such integrated circuits (ICs), etc. Examples of support circuitry may include chipsets (e.g., Northbridge, Southbridge, etc. available from the Intel Corporation) configured to provide an interface via which processing circuitry 204 may interact with other system components that may be operating at different speeds, on different buses, etc. in device 200. Moreover, some or all of the functionality commonly associated with the support circuitry may also be included in the same physical package as the processor (e.g., such as in the Sandy Bridge family of processors available from the Intel Corporation).

Processing circuitry 204 may be configured to execute various instructions in device 200. Instructions may include program code configured to cause processing circuitry 204 to perform activities related to reading data, writing data, processing data, formulating data, converting data, transforming data, etc. Information (e.g., instructions, data, etc.) may be stored in memory circuitry 206. Memory circuitry 206 may comprise random access memory (RAM) and/or read-only memory (ROM) in a fixed or removable format. RAM may include volatile memory configured to hold information during the operation of device 200 such as, for example, static RAM (SRAM) or Dynamic RAM (DRAM). ROM may include non-volatile (NV) memory circuitry configured based on BIOS, UEFI, etc. to provide instructions when device 200 is activated, programmable memories such as electronic programmable ROMs (EPROMS), Flash, etc. Other fixed/removable memory may include, but are not limited to, magnetic memories such as, for example, floppy disks, hard drives, etc., electronic memories such as solid state flash memory (e.g., embedded multimedia card (eMMC), etc.), removable memory cards or sticks (e.g., micro storage device (uSD), USB, etc.), optical memories such as compact disc-based ROM (CD-ROM), Digital Video Disks (DVD), Blu-Ray Disks, etc.

Power circuitry 208 may include internal power sources (e.g., a battery, fuel cell, etc.) and/or external power sources (e.g., electromechanical or solar generator, power grid, external fuel cell, etc.), and related circuitry configured to supply device 200 with the power needed to operate. User interface circuitry 210 may include hardware and/or software to allow users to interact with device 200 such as, for example, various input mechanisms (e.g., microphones, switches, buttons, knobs, keyboards, speakers, touch-sensitive surfaces, one or more sensors configured to capture images and/or sense proximity, distance, motion, gestures, orientation, biometric data, etc.) and various output mechanisms (e.g., speakers, displays, lighted/flashing indicators, electromechanical components for vibration, motion, etc.). The hardware in user interface circuitry 210 may be incorporated within device 200 and/or may be coupled to device 200 via a wired or wireless communication medium. In an example implementation wherein device 200 is made up of multiple devices, user interface circuitry 210 may be optional in devices such as, for example, servers (e.g., rack server, blade server, etc.) that omit user interface circuitry 210 and instead rely on another device (e.g., an operator terminal) for user interface functionality.

Communications interface circuitry 212 may be configured to manage packet routing and other functionality for communication circuitry 214, which may include resources configured to support wired and/or wireless communications. In some instances, device 200 may comprise more than one set of communication circuitry 214 (e.g., including separate physical interface circuitry for wired protocols and/or wireless radios) managed by communications interface circuitry 212. Wired communications may include serial and parallel wired or optical mediums such as, for example, Ethernet, USB, Firewire, Thunderbolt, Digital Video Interface (DVI), High-Definition Multimedia Interface (HDMI), etc. Wireless communications may include, for example, close-proximity wireless mediums (e.g., radio frequency (RF) such as based on the RF Identification (RFID) or Near Field Communications (NFC) standards, infrared (IR), etc.), short-range wireless mediums (e.g., Bluetooth, WLAN, Wi-Fi, ZigBee, etc.), long range wireless mediums (e.g., cellular wide-area radio communication technology, satellite-based communications, etc.), electronic communications via sound waves, lasers, etc. In one embodiment, communications interface circuitry 212 may be configured to prevent wireless communications that are active in communication circuitry 214 from interfering with each other. In performing this function, communications interface circuitry 212 may schedule activities for communication circuitry 214 based on, for example, the relative priority of messages awaiting transmission. While the embodiment disclosed in FIG. 2 illustrates communications interface circuitry 212 being separate from communication circuitry 214, it may also be possible for the functionality of communications interface circuitry 212 and communication circuitry 214 to be incorporated into the same circuitry.

Consistent with the present disclosure, communication circuitry 214 may be capable of providing the functionality generally described in FIG. 1 as associated with interface 106. Data collection circuitry 108', data analysis circuitry 110' and output circuitry 112' may comprise, for example, hardware or a combination of both hardware and software. In at least one embodiment, circuitry 108', 110' and/or 112' may be formulated utilizing one or more of discrete components, integrated circuits (ICs), groups of ICs (e.g., chipsets), SoCs, etc. Alternatively, at least a portion of circuitry 108', 110' and/or 112' may comprise code including instructions, data, etc. that may transform generalized circuitry in device 200 (e.g., processing circuitry 204, memory circuitry 206, etc.) into specialized circuitry at least to perform functionality as described herein. For example, data collection circuitry 108' may interact with at least communication circuitry 214 to receive sensor data 104A . . . F and may then provide sensor data 104A . . . F to data analysis circuitry 110'. Data analysis circuitry 110' may interact with processing circuitry 204 to analyze sensor data 104A . . . F and may then provide an objective determination to output circuitry 112'. Output circuitry 112' may interact with one or both of user interface circuitry 210 or communication circuitry 214 when it generates a notification regarding the objective determination (e.g., the determination of whether an infraction occurred). For example, output circuitry 112' may cause user interface circuitry 210 to present an audible, visible and/or tactile notification and/or may cause communication circuitry 214 to transmit a signal to cause another device to present a notification, stop a game clock, etc.

Any or all of example sensor devices 102A . . . F' may comprise at least communication circuitry 214', optional security circuitry 216 and sensing circuitry 218. Security circuitry 216 may be optional based on, for example, limitations in a particular sensor device 102A . . . F' (e.g., power, space, processing capacity, etc. may be extremely limited in some mobile devices), the requirements of system 100, etc. Communication circuitry 214' may provide wired and/or wireless communication functionality similar to communication circuitry 214. Security circuitry 216 may perform security operations prior to communication circuitry 214' transmitting sensor data 104A . . . F generated by sensing circuitry 218. Examples of security operations may include encrypting sensor data 104A . . . F utilizing authentication data, inserting authentication data into sensor data 104A . . . F or into a message including sensor data 104A . . . F to be transmitted by communication circuitry 214', etc. Sensing circuitry 218 may comprise at least one sensor to generate sensor data 104A . . . F based on measured quantities such as in the above examples.

Consistent with the present disclosure, an example implementation may build upon the electrical phenomena and properties of the human body, sports equipment and air. The human body is a good electrical conductor. Sports equipment may be manufactured to have specific conductive and/or insulative properties. Air is a good insulator. The physics of motion and inter-body collisions may be determined utilizing a collection of electrical field emitters and circuit/motion sensors. Logic may process the sensor data relative to a defined context and cause an alerting system to generate a notification regarding the results. For example, an embodiment may employ electrical field emitters located on players and/or embedded in sports equipment that may generate uniquely identifiable signatures embedded within the electrical field (e.g., via pulse width modulation (PWM), different frequencies, digital codes embedded in the frequency, etc.), and may be transmitted through the players body and through the equipment. Also located on players and/or embedded in the sports equipment may be sensors that detect the completion of an electrical circuit and position, acceleration and/or orientation sensors. When players and/or equipment come into contact, a circuit may be established for the electrical field signatures to be transmitted across the players and equipment. These transmitted signals may then be detected by the sensors on both sides of the contacted bodies, and thus used to register (e.g., and to validate by means of the two-way nature of the signal transmission) physical contact between the bodies and/or equipment. The unique electrical field signatures may be decoded to identify the specific contacting body. Knowledge of the sensor location on a body and precise measures of timing of signal transmission registered at different devices on a body may be used to identify where the contact actually occurred (e.g., the hand of one player contacting the forearm of another player).

In one example implementation, contact detection circuitry in sensor devices 102A . . . F' (e.g., corresponding to sensor circuitry 218) may comprise variety of components to generate a uniquely identifiable electrical field transmitted through the body, detect and decode electrical signals transmitted from other bodies through contact, an inertial measurement component (e.g., some combination of accelerometers, angular rate gyros, magnetometers, etc.), a precision clock/microcontroller to synchronize different measurements and/or analyze sensor data, and a communications component (e.g., communication circuitry 214') to transmit/receive sensed data 104A . . . F to a centralized analysis and alert function (e.g., at least one device 200). In at least one embodiment, the clocks/timing of all devices within system 100 (e.g., devices 102A . . . F' and device 200) may at least be synchronized, and may further be hard-synchronized (e.g., based on hardware-driven technology to ensure that the clocks maintain the same timing). Similar sensor devices 102A . . . F' may be embedded in associated sports equipment, in a play area, etc.

Figure 3:
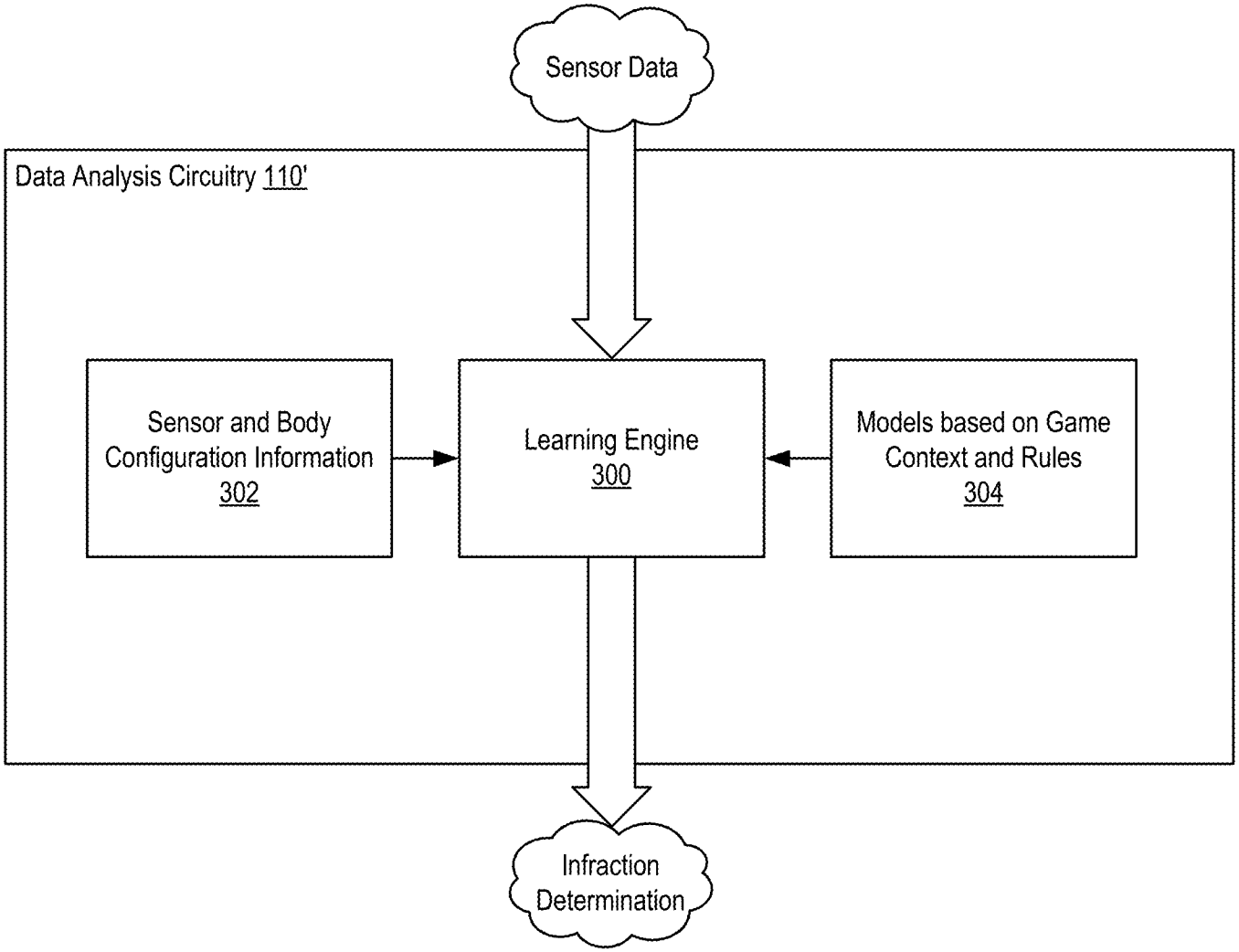
FIG. 3 illustrates an example configuration for data analysis circuitry in accordance with at least one embodiment of the present disclosure.

FIG. 3 illustrates an example configuration for data analysis circuitry in accordance with at least one embodiment of the present disclosure. Data analysis circuitry 110' may correspond to an example embodiment applicable to sporting events, and may include, for example, learning engine 300, sensor and body configuration information 302 and models based on game context and rules 304. Learning engine 300 may comprise circuitry and software (e.g., at least a program to transform processing circuitry 204 into specialized circuitry) to "learn" sensor data 104A . . . F that may constitute potential infractions. Learning may include one or more teaching operations through which models 304 are formulated. In the teaching operations, sensor data 104A . . . F that is known to correspond to infractions may be associated with infractions in models 304. During actual operation learning engine 300 may use configuration information 302 to categorize sensor data 104A . . . F received from data collection circuitry 108. Configuration information 302 may comprise, for example, data on the players participating in a sporting event, the equipment in the sporting event, the play area, etc. This data may identify a location, type, security level, etc. of sensor devices 102A . . . F involved in a sporting event, the players that are active in the sporting event vs. the players that are inactive or "on the bench" to allow data analysis circuitry 110' to differentiate between (e.g., filter between) sensor data that should be considered vs. sensor data that should be ignored, etc. The data may be categorized based on, for example, particular sensor devices 102A . . . F that provided the data (e.g., player-mounted, equipment-mounted, play area-mounted, etc.), the number of sensor devices 102A . . . F providing sensor data 104A . . . F, type of sensor data 104A . . . F received (e.g., contact data, proximity data, force data, acceleration data, etc.), etc. In at least one embodiment, a single model may be used for all potential events (e.g., infractions and/or positive game aspects). Alternatively, different models may be employed for different potential events. For example, the category determined by learning engine 300 based on configuration information 302 may be employed in selecting a model from models 304. Learning engine 300 may input some or all of sensor data 104A . . . F into the model, which may compare the sensor data to, for example, prior sensor data that was established as indicative of infractions, and may make an objective determination based on the output of the model (e.g., make an infraction determination as shown in the example of FIG. 3).

Figure 4:
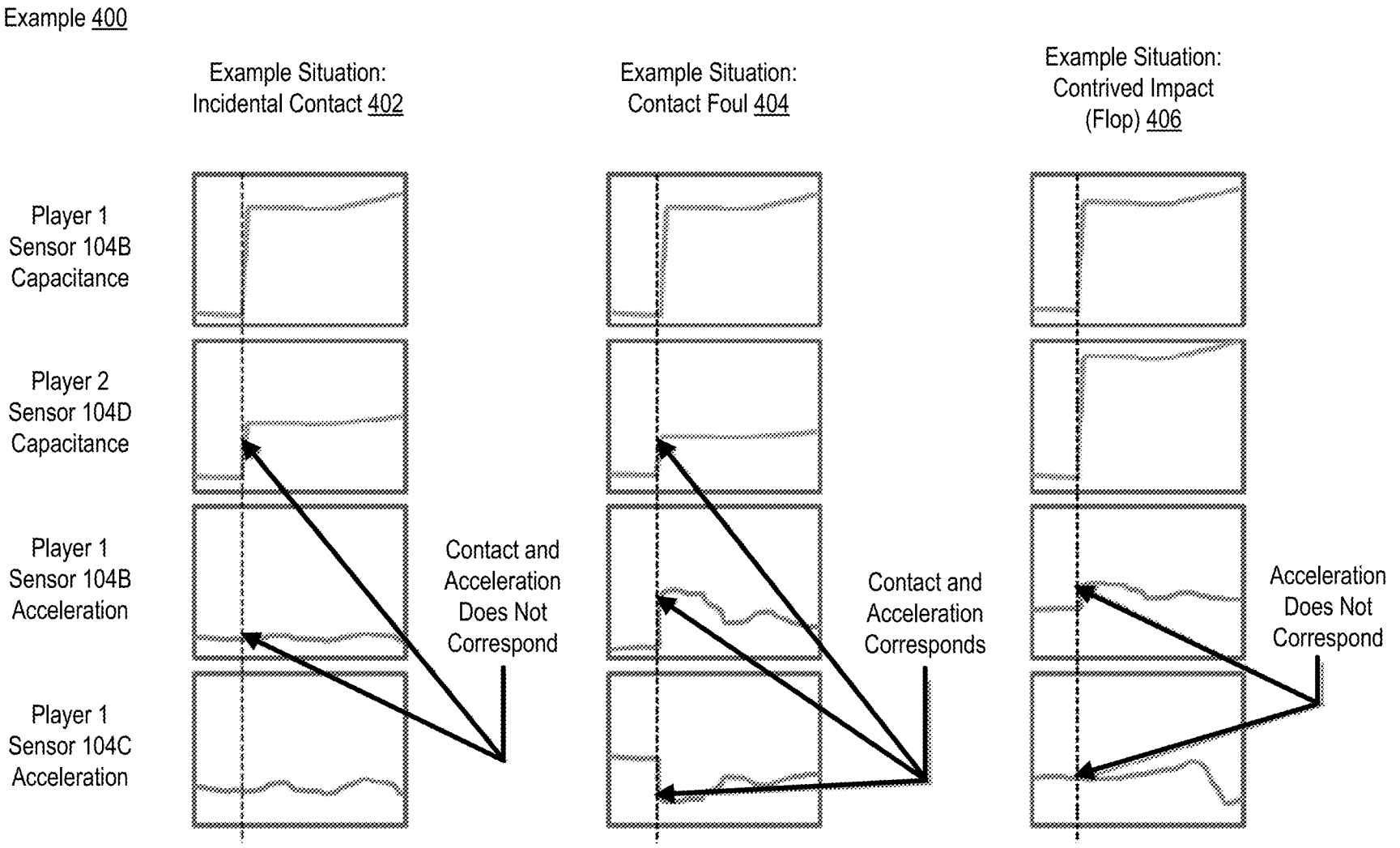
FIG. 4 illustrates example sensor data and how the example sensor data may be interpreted in accordance with at least one embodiment of the present disclosure.

FIG. 4 illustrates example sensor data and how the example sensor data may be interpreted in accordance with at least one embodiment of the present disclosure. In an example of operation, sensor data 104A . . . F from players and/or equipment (e.g., acceleration, angular rotation rate, magnetometer orientation, etc.) and models of inter-body dynamics and collisions may be used to interpret the cause-effect relationships between the contact and the motion. In example 400, the capacitance and acceleration of player 1 and player 2 are being measured, and example situations 402 to 406 describe objective determinations (e.g., of whether an infraction occurred) based on how sensed data 104A . . . F may be interpreted by data analysis circuitry 110.

In example situation 402, registering contact that does not involve any dynamic effects on either body infers incidental contact (e.g., an insignificant touch), and an objective determination of no infraction. However, if both bodies register contact and exhibit time-synchronized kinetic energy exchange as shown in example situation 404 wherein the sensed contact and acceleration correspond, the event infers a collision with a causal effect—the significance of which would be associated with the magnitude of the associated accelerations. As a result, in example situation 404 an objective determination may be that an infraction (e.g., foul) has occurred. Alternatively, if the accelerations of the different bodies are either not time-synchronized or asymmetric in the magnitude of the response as shown in example situation 406, the result would be indicative of contrived motion or embellishment (e.g., that at least one of the players is "acting" like contact occurred when it did not actually occur. The objective determination in this instance, based on the particular application of system 100 being to basketball, may be that at least one of player 1 or player 2 is "flopping," for which a penalty may be assessed to the flopping player.

Figure 5:
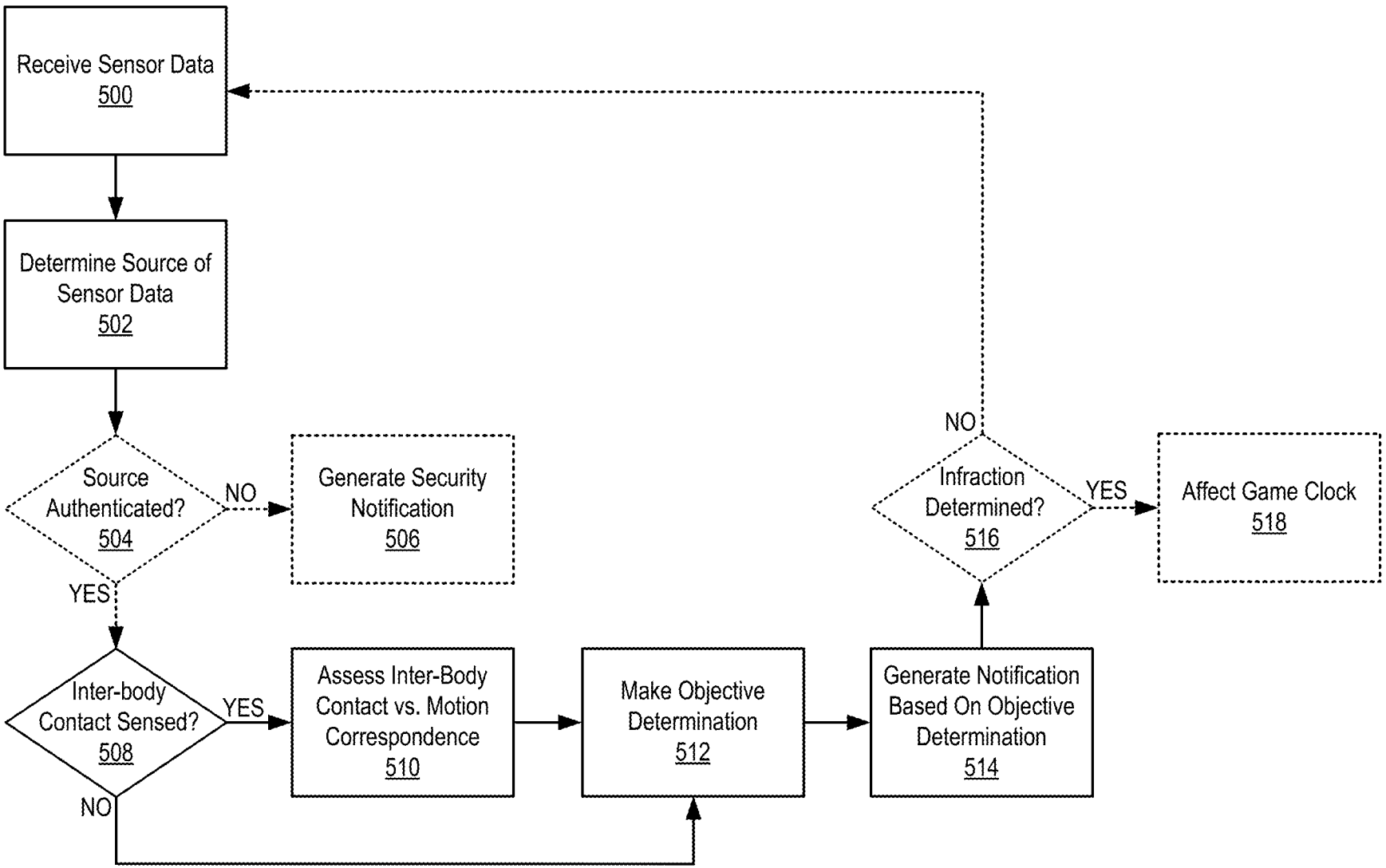
FIG. 5 illustrates example operations for sensor-based objective determination in accordance with at least one embodiment of the present disclosure.

FIG. 5 illustrates example operations for sensor-based objective determination in accordance with at least one embodiment of the present disclosure. Operations illustrated with a dotted line may be optional in that they may only be employed in certain embodiments based on, for example, the limitations or requirements of the objective determination system. In operation 500 sensor data may be received. Sensor data may be received, for example, on a periodic basis, pulled by requests made by data collection circuitry, pushed on an event-driven basis by sensor devices, etc. A source for the sensor data received in operation 500 may then be determined in operation 502. A determination may then be made in operation 504 as to whether the source of the sensor data can be authenticated. Authentication may include, for example, decrypting the sensor data with data specific to the presumed source of the sensor data, authenticating security data provided along with the sensor data, etc. If it is determined in operation 504 that the source cannot be authenticated, then in operation 506 a security notification may be generated. The security notification may, for example, present a visible, audible and/or tactile notification to officials that a security problem exists, identifies a source that cannot be authenticated, etc.

If in operation 504 it is determined that the source of the sensor data can be authenticated, then in operation 508 a further determination may be made as to whether the sensor data includes inter-body contact data (e.g., data indicative of two players coming into contact with each other). If in operation 508 it is determined that the sensor data indicates inter-body contact has occurred, then in operation 510 inter-body contact vs. motion correspondence may be assessed, which may determine, for example, areas of the bodies making the contact, timing between the contact and the motion, timing of the motion with respect to the first and second bodies, motion of the bodies relative to each other, etc.

An objective determination may then be made in operation 512. For example, at least one model may be selected based on the determination made in operations 508 and 510, sensor data may be input into the model, and the objective determination (e.g., a determination about whether an infraction occurred) may be made. In operation 514, a notification may be generated based on the objective determination. In at least one embodiment, the notification may present a visible, textual, tactile, etc. indication of whether an infraction was determined to have occurred. If in operation 516 it is determined that an infraction did occur, then in operation 518 the game clock may be affected (e.g., stopped, started, reset, adjusted, another game clock may be started, etc.). For example, the clock may be directly controlled by output circuitry or a signal may be transmitted to another control system to cause the clock to stop. A determination in operation 516 that an infraction has not occurred may be followed by a return to operation 500 to await the next receipt of sensor data. Returning to operation 508, a determination that the received sensor data does not comprise inter-body contact data (e.g., the sensor data comprises data about equipment contact with an out-of-bounds sensor or another play area sensor like a three point line sensor, with a player or other sensed data) may be followed by operation 512 wherein an objective determination may be made without having to perform the assessment of operation 510. In at least one embodiment, at least operation 508 may be deemed to "categorize" the received sensor data prior to an objective determination being rendered.

While FIG. 5 illustrates operations according to an embodiment, it is to be understood that not all of the operations depicted in FIG. 5 are necessary for other embodiments. Indeed, it is fully contemplated herein that in other embodiments of the present disclosure, the operations depicted in FIG. 5, and/or other operations described herein, may be combined in a manner not specifically shown in any of the drawings, but still fully consistent with the present disclosure. Thus, claims directed to features and/or operations that are not exactly shown in one drawing are deemed within the scope and content of the present disclosure.

As used in this application and in the claims, a list of items joined by the term "and/or" can mean any combination of the listed items. For example, the phrase "A, B and/or C" can mean A; B; C; A and B; A and C; B and C; or A, B and C. As used in this application and in the claims, a list of items joined by the term "at least one of" can mean any combination of the listed terms. For example, the phrases "at least one of A, B or C" can mean A; B; C; A and B; A and C; B and C; or A, B and C.

As used in any embodiment herein, the terms "system" or "module" may refer to, for example, software, firmware and/or circuitry configured to perform any of the aforementioned operations. Software may be embodied as a software package, code, instructions, instruction sets and/or data recorded on non-transitory computer readable storage mediums. Firmware may be embodied as code, instructions or instruction sets and/or data that are hard-coded (e.g., non-volatile) in memory devices. "Circuitry", as used in any embodiment herein, may comprise, for example, singly or in any combination, hardwired circuitry, programmable circuitry such as computer processors comprising one or more individual instruction processing cores, state machine circuitry, and/or firmware that stores instructions executed by programmable circuitry or future computing paradigms including, for example, massive parallelism, analog or quantum computing, hardware embodiments of accelerators such as neural net processors and non-silicon implementations of the above. The circuitry may, collectively or individually, be embodied as circuitry that forms part of a larger system, for example, an integrated circuit (IC), system on-chip (SoC), desktop computers, laptop computers, tablet computers, servers, smartphones, etc.

Any of the operations described herein may be implemented in a system that includes one or more storage mediums (e.g., non-transitory storage mediums) having stored thereon, individually or in combination, instructions that when executed by one or more processors perform the methods. Here, the processor may include, for example, a server CPU, a mobile device CPU, and/or other programmable circuitry. Also, it is intended that operations described herein may be distributed across a plurality of physical devices, such as processing structures at more than one different physical location. The storage medium may include any type of tangible medium, for example, any type of disk including hard disks, floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, Solid State Disks (SSDs), embedded multimedia cards (eMMCs), secure digital input/output (SDIO) cards, magnetic or optical cards, or any type of media suitable for storing electronic instructions. Other embodiments may be implemented as software executed by a programmable control device.

Thus, the present disclosure is directed to a system for sensor-based objective determination. In general, sensor data may be used to render objective determinations that were not previously possible due to the unavoidable subjectivity of human-based officiating systems. For example, at least one device may be configured to make objective determinations during the course of a sporting event. Data collection circuitry may receive data from sensor devices coupled to players, equipment, playing surfaces, etc. Data analysis circuitry may categorize the data and input the data into a model to determine if an infraction occurred. For example, categorization may involve determining a type of infraction that may have occurred based on the sensor data. The model may then be selected based on the type of infraction, the model being developed utilizing prior sensor data, rules for the sporting event, etc. Output circuitry may generate a notification based on the infraction determination.

The following examples pertain to further embodiments. The following examples of the present disclosure may comprise subject material such as at least one device, a method, at least one machine-readable medium for storing instructions that when executed cause a machine to perform acts based on the method, means for performing acts based on the method and/or a system for analytic model development.

According to example 1 there is provided at least one device for sensor-based objective determination. The at least one device may comprise communication circuitry to transmit and receive data, data collection circuitry to receive sensor data via the communication circuitry from at least one sensor device configured to monitor a sporting event and data analysis circuitry to determine a category for the sensor data, input the sensor data into a model based on the category, determine whether an infraction occurred based on a model output and output circuitry to generate a notification based on the infraction determination.

Example 2 may include the elements of example 1, wherein the data analysis circuitry is to categorize sensor data received from at least one of a uniform sensor device, an equipment sensor device or a playing field sensor device as a potential individual infraction.

Example 3 may include the elements of example 2, wherein the data analysis circuitry is to determine an out-of-bounds infraction based on sensor data received from at least one of the equipment sensor device or the playing field sensor device.

Example 4 may include the elements of any of examples 1 to 3, wherein the data analysis circuitry comprises at least a learning engine to determine whether an infraction occurred based on the model.

Example 5 may include the elements of example 4, wherein the data analysis circuitry further comprises at least sensor and body configuration circuitry.

Example 6 may include the elements of any of examples 4 to 5, wherein the model is developed based at least on prior sensor data and rules governing the sporting event.

Example 7 may include the elements of any of examples 4 to 6, wherein the data analysis circuitry is to categorize sensor data received from at least one player sensor device as a potential player-on-player infraction, the sensor data including at least contact data and acceleration data.

Example 8 may include the elements of any of examples 4 to 7, wherein the data analysis circuitry is to categorize sensor data received from at least one player sensor device as a potential player-on-player infraction.

Example 9 may include the elements of example 8, wherein the sensor data received from the at least one player sensor device comprises at least contact data and acceleration data.

Example 10 may include the elements of example 9, wherein the learning engine is to determine characteristics for contact that occurred between players in the sporting event based on the contact data and whether the contact constitutes an infraction based at least on the acceleration data.

Example 11 may include the elements of any of examples 1 to 10, wherein the data analysis circuitry is to cause a timing device for the sporting event to be affected based on the sensor data.

Example 12 may include the elements of any of examples 1 to 11, wherein the notification includes at least one of a visible, audible or haptic notification to at least one person officiating the sporting event.

Example 13 may include the elements of any of examples 1 to 12, wherein the notification includes presenting a replay of events in the sporting event leading up to the infraction on at least one monitor.

Example 14 may include the elements of any of examples 1 to 13, wherein at least one of the data collection circuitry or the data analysis circuitry is to authenticate that the sensor data originated from the at least one sensor device.

Example 15 may include the elements of example 14, wherein the sensor data is authenticated based on source data incorporated within the sensor data by the at least one sensor device.

Example 16 may include the elements of any of examples 1 to 15, further comprising clock circuitry hard synchronized to clock circuitry in the at least one sensor module.

According to example 17 there is provided a sensor device. The sensor device may comprise communication circuitry to transmit and receive data, sensor circuitry to generate sensor data regarding a sporting event and security circuitry to incorporate security data into the sensor data.

Example 18 may include the elements of example 17, wherein the sensor circuitry is configured to at least sense when a player wearing the sensor device contacts another player and acceleration of the player at least during a period of time when the sensed contact occurred.

Example 19 may include the elements of any of examples 17 to 18, wherein the security data is based on biometric data from a player assigned to wear the sensor device and participating in the sporting event.

Example 20 may include the elements of any of examples 17 to 19, further comprising clock circuitry hard synchronized to clock circuitry of a system in which the at least one sensor device operates.

According to example 21 there is provide a method for sensor-based objective determination. The method may comprise receiving sensor data from at least one sensor device configured to monitor a sporting event, categorizing the sensor data, inputting the sensor data into a model based on the category, determining whether an infraction occurred based on a model output and generating a notification based on the infraction determination.

Example 22 may include the elements of example 21, and may further comprise authenticating that the sensor data originated from the at least one sensor device and generating a security notification if the sensor data cannot be authenticated.

Example 23 may include the elements of any of examples 21 to 22, wherein categorizing the sensor data comprises determining if the sensor data comprises contact data.

Example 24 may include the elements of example 23, wherein if the sensor data is determined to comprise contact data, further comprising assessing the contact data in view of acceleration data sensed at least during a period of time the contact data was sensed prior to determining whether an infraction occurred.

Example 25 may include the elements of any of examples 21 to 24, wherein the model is developed based at least on prior sensor data and rules governing the sporting event.

Example 26 may include the elements of any of examples 21 to 25, and may further comprise causing a game clock to be affected based on a determination that an infraction occurred.

Example 27 may include the elements of example 26, and may further comprise determining if the sensor data comprises contact data, and if the sensor data is determined to comprise contact data, assessing the contact data in view of acceleration data sensed at least during a period of time the contact data was sensed prior to determining whether an infraction occurred.

Example 28 may include the elements of any of examples 21 to 27, and may further comprise synchronizing clock circuitry in the at least one sensor device to clock circuitry of a system in which the at least one sensor device operates.

According to example 29 there is provided a system including at least one device, the system being arranged to perform the method of any of the above examples 21 to 28.

According to example 30 there is provided a chipset arranged to perform the method of any of the above examples 21 to 28.

According to example 31 there is provided at least one machine readable medium comprising a plurality of instructions that, in response to be being executed on a computing device, cause the computing device to carry out the method according to any of the above example 21 to 28.

According to example 32 there is provided at least one device for sensor-based objective determination, the at least one device being arranged to perform the method of any of the above examples 21 to 28.

According to example 33 there is provided a system for sensor-based objective determination. The system may comprise means for receiving sensor data from at least one sensor device configured to monitor a sporting event, means for categorizing the sensor data, means for inputting the sensor data into a model based on the category, means for determining whether an infraction occurred based on a model output and means for generating a notification based on the infraction determination.

Example 34 may include the elements of example 33, and may further comprise means for authenticating that the sensor data originated from the at least one sensor device and means for generating a security notification if the sensor data cannot be authenticated.

Example 35 may include the elements of any of examples 33 to 34, wherein the means for categorizing the sensor data comprise means for determining if the sensor data comprises contact data.

Example 36 may include the elements of example 35, wherein if the sensor data is determined to comprise contact data, further comprising means for assessing the contact data in view of acceleration data sensed at least during a period of time the contact data was sensed prior to determining whether an infraction occurred.

Example 37 may include the elements of any of examples 33 to 36, wherein the model is developed based at least on prior sensor data and rules governing the sporting event.

Example 38 may include the elements of any of examples 33 to 37, and may further comprise means for causing a game clock to be affected based on a determination that an infraction occurred.

Example 39 may include the elements of any of examples 33 to 38, and may further comprise means for determining if the sensor data comprises contact data and means for, if the sensor data is determined to comprise contact data, assessing the contact data in view of acceleration data sensed at least during a period of time the contact data was sensed prior to determining whether an infraction occurred.

Example 40 may include the elements of any of examples 33 to 39, and may further comprise means for synchronizing clock circuitry in the at least one sensor device to clock circuitry of a system in which the at least one sensor device operates.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

What is claimed:

1. A sensor-based objective determination system, comprising:

communication circuitry to transmit and receive data;

data collection circuitry to receive sensor data via the communication circuitry from a first contact sensor circuitry to generate a first contact output signal, a second contact sensor circuitry to generate a second contact output signal, a first acceleration sensor circuitry to generate a first acceleration output signal, and a second acceleration sensor circuitry to generate a second acceleration output signal, each configured to monitor a sporting event;

wherein, the first contact sensor circuitry and the first acceleration sensor circuitry are attached to a first player, uniform, piece of equipment, or playing field; and wherein, the second contact sensor circuitry and the second acceleration sensor circuitry are attached to a second player, uniform, piece of equipment, or playing field; and data analysis circuitry to determine a contact type based on the sensor data by comparing the first and second contact output signals to the first and second acceleration output signals;

wherein, an incidental contact type is determined based on time-synchronization of sensor data indicating contact from the first contact output signal and the second contact output signal without corresponding sensor data indicating acceleration from either the first acceleration output signal or the second acceleration output signal;

wherein, a collision contact type is determined based on time-synchronization of sensor data indicating contact from the first contact output signal and the second contact output signal with corresponding sensor data indicating acceleration from both the first acceleration output signal and the second acceleration output signal;

wherein, a contrived impact contact type is determined based on time-synchronization of sensor data indicating contact from the first contact output signal and the second contact output signal with corresponding sensor data indicating acceleration from only either the first acceleration output signal or the second acceleration output signal; and wherein, sensor data indicating contact or acceleration is determined based on prior sensor data and rules governing the sporting event; and output circuitry to generate a notification based on the infraction determination.

2. The sensor-based objective determination system of claim 1, wherein the data analysis circuitry comprises a learning engine that uses sensor data corresponding with known contact types to determine sensor data indicating contact or acceleration.

3. The sensor-based objective determination system of claim 1, wherein the data analysis circuitry is to cause a timing device for the sporting event to be affected based on the sensor data.

4. The sensor-based objective determination system of claim 1, wherein at least one of the data collection circuitry or the data analysis circuitry is to authenticate that the sensor data originated from the first contact sensor circuitry, the second contact sensor circuitry, the first acceleration sensor circuitry, or the second acceleration sensor circuitry.

5. The sensor-based objective determination system of claim 4, wherein the sensor data is authenticated based on source data incorporated within the sensor data.

6. A method for sensor-based objective determination, comprising:

receiving sensor data from a first contact sensor circuitry to generate a first contact output signal, a second contact sensor circuitry to generate a second contact output signal, a first acceleration sensor circuitry to generate a first acceleration output signal, and a second acceleration sensor circuitry to generate a second acceleration output signal, each configured to monitor a sporting event;

wherein, the first contact sensor circuitry and the first acceleration sensor circuitry are attached to a first player, uniform, piece of equipment, or playing field; and wherein, the second contact sensor circuitry and the second acceleration sensor circuitry are attached to a second player, uniform, piece of equipment, or playing field; and determining a contact type based on the sensor data by comparing the first and second contact output signals to the first and second acceleration output signals;

wherein, an incidental contact type is determined based on time-synchronization of sensor data indicating contact from the first contact output signal and the second contact output signal without corresponding sensor data indicating acceleration from either the first acceleration output signal or the second acceleration output signal;

wherein, a collision contact type is determined based on time-synchronization of sensor data indicating contact from the first contact output signal and the second contact output signal with corresponding sensor data indicating acceleration from both the first acceleration output signal and the second acceleration output signal;

wherein, a contrived impact contact type is determined based on time-synchronization of sensor data indicating contact from the first contact output signal and the second contact output signal with corresponding sensor data indicating acceleration from only either the first acceleration output signal or the second acceleration output signal; and wherein, sensor data indicating contact or acceleration is determined based on prior sensor data and rules governing the sporting event; and generating a notification based on the infraction determination.

7. The method of claim 6, further comprising:

authenticating that the sensor data originated from the first contact sensor circuitry, the second contact sensor circuitry, the first acceleration sensor circuitry, or the second acceleration sensor circuitry; and generating a security notification if the sensor data cannot be authenticated.

8. The method of claim 6, further comprising:

causing a game clock to be affected based on a determination that an infraction occurred.

9. At least one machine-readable storage device having stored thereon, individually or in combination, instructions for sensor-based objective determination that, when executed by one or more processors, cause the one or more processors to:

receive sensor data from a first contact sensor circuitry to generate a first contact output signal, a second contact sensor circuitry to generate a second contact output signal, a first acceleration sensor circuitry to generate a first acceleration output signal, and a second acceleration sensor circuitry to generate a second acceleration output signal, each configured to monitor a sporting event;

wherein, the first contact sensor circuitry and the first acceleration sensor circuitry are attached to a first player, uniform, piece of equipment, or playing field; and wherein, the second contact sensor circuitry and the second acceleration sensor circuitry are attached to a second player, uniform, piece of equipment, or playing field; and determine a contact type based on the sensor data by comparing the first and second contact output signals to the first and second acceleration output signals;

wherein, an incidental contact type is determined based on time-synchronization of sensor data indicating contact from the first contact output signal and the second contact output signal without corresponding sensor data indicating acceleration from either the first acceleration output signal or the second acceleration output signal;

wherein, a collision contact type is determined based on time-synchronization of sensor data indicating contact from the first contact output signal and the second contact output signal with corresponding sensor data indicating acceleration from both the first acceleration output signal and the second acceleration output signal;

wherein, a contrived impact contact type is determined based on time-synchronization of sensor data indicating contact from the first contact output signal and the second contact output signal with corresponding sensor data indicating acceleration from only either the first acceleration output signal or the second acceleration output signal; and wherein, sensor data indicating contact or acceleration is determined based on prior sensor data and rules governing the sporting event; and generate a notification based on the infraction determination.

10. The storage device of claim 9, wherein the instructions further cause the one or more processors to:

authenticate that the sensor data originated from the first contact sensor circuitry, the second contact sensor circuitry, the first acceleration sensor circuitry, or the second acceleration sensor circuitry; and generate a security notification if the sensor data cannot be authenticated.

11. The storage device of claim 9, wherein the instructions further cause the one or more processors to:

cause a game clock to be affected based on a determination that an infraction occurred.

* * * * *